US006886456B2

(12) United States Patent
Tonello

(10) Patent No.: US 6,886,456 B2
(45) Date of Patent: May 3, 2005

(54) ANCHOR DEVICE FOR ANCHORING A PERIPHERAL EDGE OF A PRESS BLANKET

(75) Inventor: Fabrizio Tonello, Cervasca (IT)

(73) Assignee: PMT Italia SpA, Pinerolo (IT)

( * ) Notice: Subject to any disclaimer, the term of this patent is extended or adjusted under 35 U.S.C. 154(b) by 0 days.

(21) Appl. No.: 10/467,779

(22) PCT Filed: Feb. 13, 2001

(86) PCT No.: PCT/EP01/01960

§ 371 (c)(1),
(2), (4) Date: Aug. 9, 2003

(87) PCT Pub. No.: WO02/064885

PCT Pub. Date: Aug. 22, 2002

(65) Prior Publication Data

US 2004/0060460 A1 Apr. 1, 2004

(51) Int. Cl.[7] ..... B30B 5/04; D21F 3/02; B25F 5/02

(52) U.S. Cl. ..... 100/153; 162/272; 162/358.3; 492/47

(58) Field of Search ..... 100/118, 153, 100/154, 211; 162/272, 358.3, 358.4; 29/895.22; 492/45, 47

(56) References Cited

U.S. PATENT DOCUMENTS 4,944,089 A * 7/1990 Flamig et al. ..... 29/895.22
4,975,152 A * 12/1990 Filzen et al. ..... 162/358.3
5,084,137 A * 1/1992 Ilmarinen et al. ..... 162/272
5,496,442 A * 3/1996 Laapotti ..... 162/199
5,700,357 A * 12/1997 Didier ..... 162/358.3
5,733,415 A * 3/1998 Breiten ..... 162/358.3

FOREIGN PATENT DOCUMENTS

DE 29702362 * 5/1997 ..... F16C/13/00

* cited by examiner

*Primary Examiner*—Allen Ostrager
*Assistant Examiner*—Jimmy Nguyen
(74) *Attorney, Agent, or Firm*—David J. Archer

(57) ABSTRACT

In an enclosed shoe press having a press blanket extending through an extended nip defined between a backing roll and a press shoe, an anchor device is disclosed for anchoring a peripheral edge of the press blanket. The anchor device includes a rotatable head which defines a conical peripheral surface for supporting the blanket. A ring defines a concave surface which cooperates with the conical surface of the rotatable head such that the peripheral edge of the blanket is anchored between the conical surface of the head and the concave surface of the ring. Also, a pin extends radially inwardly from the ring, the pin engaging a hole defined by the peripheral edge of the blanket. Additionally, a plurality of barbs extend away from the concave surface for assisting in anchoring the peripheral edge of the blanket against the conical surface of the rotatable head. A mechanism is provided for urging the conical surface of the head axially away from the press shoe so that the conical surface moves towards the concave surface of the ring such that the peripheral edge of the blanket is wedged between the conical surface of the head and the concave surface of the ring. The arrangement is structured such that when the blanket extends through the extended nip and during subsequent flexing of the blanket, the peripheral edge of the blanket is firmly anchored to the conical surface of the rotatable head.

14 Claims, 4 Drawing Sheets

Fig. 3.
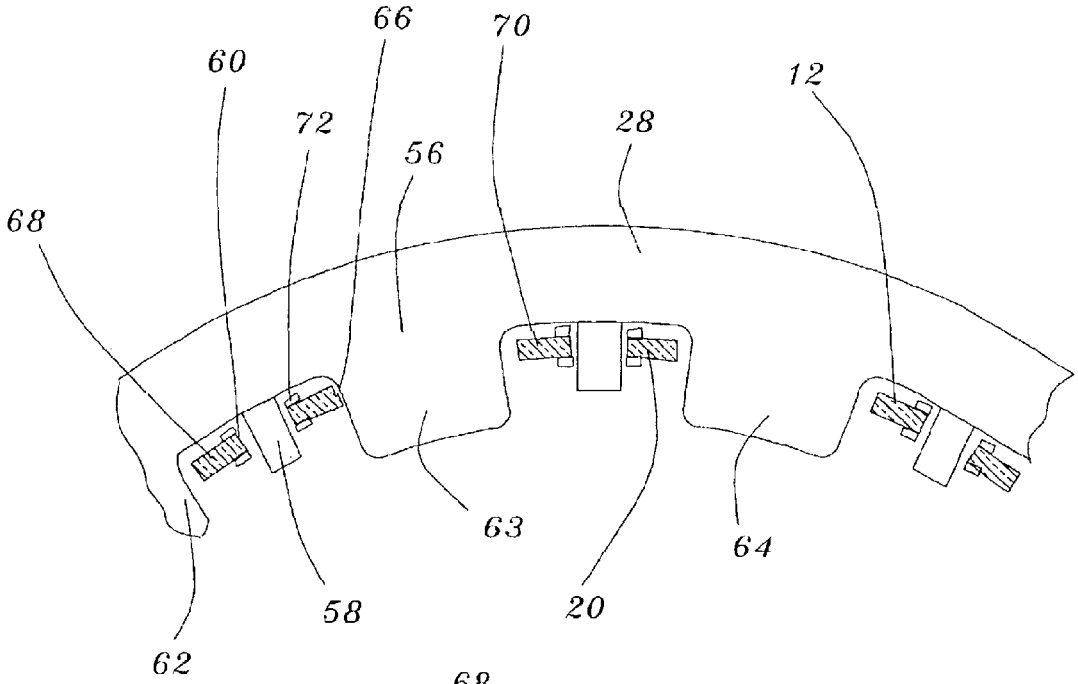
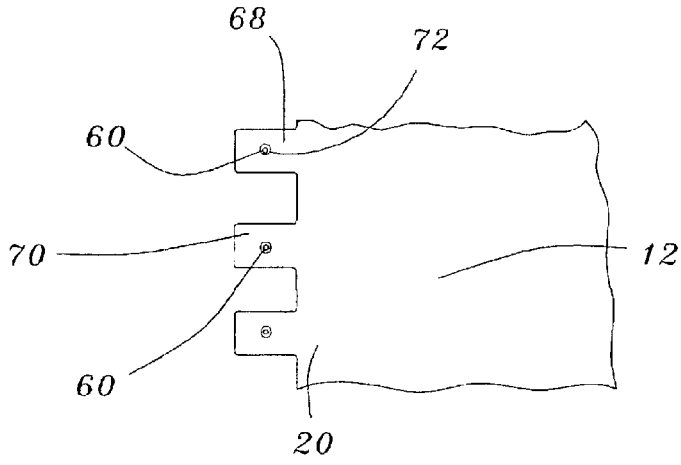
Fig. 5.

ANCHOR DEVICE FOR ANCHORING A PERIPHERAL EDGE OF A PRESS BLANKET

BACKGROUND OF THE INVENTION

1. Field of the Invention

The present invention relates to an anchor device for anchoring a peripheral edge of a press blanket. More specifically, the present invention relates to an anchor device for anchoring a peripheral edge of a press blanket in an enclosed shoe press.

2. Background Information

Shoe presses typically include a looped press blanket which extends through an extended nip defined between a rotatable backing roll and a cooperating press shoe. A web to be pressed is supported between a pair of press felts so that the felts and the web disposed between the felts pass through the extended nip such that water is pressed from the web.

One of the advantages of the shoe press over the more conventional roll press which includes cooperating press rolls, is that the residence time of the web in the extended nip arrangement is greater than the residence time of the web passing through the nip defined by the counter rotating rolls of a roll press.

More recently, shoe presses have been developed in which the closed loop of the press blanket totally encloses the elongated press shoe. One of the advantages of providing an enclosed shoe includes the confinement of lubricant mist. Such mist is generated as a result of lubricant being applied between the surface of the shoe and the press blanket sliding thereover. Such lubricant mist if not contained could contaminate the surface of the resultant web. Furthermore, such oil mist could present a slippage hazard to surrounding walkways and a potential fire hazard.

Nevertheless, in operation of an enclosed shoe press, such press blankets must be replaced when worn and it is imperative that the removal of a worn press blanket and the replacement thereof by a new blanket be accomplished as quickly as possible. Also, the edges of the new blanket must be reliably and securely anchored to the rotating heads of the enclosed shoe press. Many shoe presses operate at high speeds. Consequently, the cost of the down time required for changing a press blanket can be as much as $60,000 per hour.

The prior art arrangements for changing a press blanket have been relatively complex and have not always provided a reliable anchor for the peripheral edges of the press bearing blanket.

Therefore, it is a primary feature of the present invention to provide an anchor device that overcomes the problems associated with the prior art arrangements.

Another feature of the present invention is the provision of an anchor device that securely anchors the peripheral edge of a press blanket to a rotatable head.

A further feature of the present invention is the provision of an anchor device that facilitates changing of the blanket.

Another feature of the present invention is the provision of an anchor device that accommodates flexing of the press blanket.

Other features and advantages of the present invention will be readily apparent to those skilled in the art by a consideration of the detailed description of a preferred embodiment of the present invention contained herein.

SUMMARY OF THE INVENTION

In an enclosed shoe press having a press blanket extending through an extended nip defined between a backing roll and a press shoe, an anchor device for anchoring a peripheral edge of the press blanket. The anchor device includes a rotatable head which defines a conical peripheral surface for supporting the blanket. A ring defines a concave surface which cooperates with the conical surface of the rotatable head such that the peripheral edge of the blanket is anchored between the conical surface of the head and the concave surface of the ring. Also, a pin extends radially inwardly from the ring, the pin engaging a hole defined by the peripheral edge of the blanket. Additionally, a plurality of barbs extend away from the concave surface for assisting in anchoring the peripheral edge of the blanket against the conical surface of the rotatable head. A mechanism is provided for urging the conical surface of the head axially away from the press shoe so that the conical surface moves towards the concave surface of the ring such that the peripheral edge of the blanket is wedged between the conical surface of the head and the concave surface of the ring. The arrangement is structured such that when the blanket extends through the extended nip and during subsequent flexing of the blanket, the peripheral edge of the blanket is firmly anchored to the conical surface of the rotatable head.

In a more specific embodiment of the present invention, the rotatable head is of disc shaped configuration, the head rotating about an axis of rotation.

Also, the conical surface includes a first portion having a radius which increases in an axial direction towards the press shoe and a second portion which is disposed between the first portion and the press shoe. The second portion has a further radius which decreases in the axial direction.

Furthermore, the conical surface defines an annular groove which is disposed between the first and second portions. The device further includes an annular seal which is disposed within the annular groove. The annular seal sealingly cooperates with the blanket so that during flexing of the blanket, the annular seal seals the press shoe within the press blanket.

The device according to the present invention further includes a stop which is removably secured to the rotatable head such that the rotatable head is disposed between the stop and the press shoe. The stop is provided for limiting movement of the ring axially away from the conical surface in the event of a failure of the press blanket.

Moreover, the ring includes a first member which defines the concave surface and a second member which extends from the first member. The second member extends axially away from the conical surface.

A pin extends radially inwardly from the second member, the pin engaging a hole defined by the peripheral edge of the blanket.

Additionally, the ring includes a plurality of wings which extend radially inwardly from the second member. Each of the wings is spaced circumferentially around the rotatable head, the arrangement being such that the pin is disposed between adjacent wings of the plurality of wings.

Each wing of the plurality of wings is located within a space situated between adjacent tabs defined by the peripheral edge of the blanket.

Also, the pin disposed between the adjacent wings extends through the hole which is defined by one of the tabs.

More specifically, the pin is located within a grommet extending through the hole defined by the tab of the blanket.

Additionally, the device further includes a plurality of barbs which extend away from the concave surface of the ring towards the peripheral edge of the blanket for assisting in anchoring the peripheral edge of the blanket against the conical surface of the rotatable head.

The barbs are inclined in a direction away from the press shoe so that during flexing of the blanket, the barbs increase the anchoring of the peripheral edge of the blanket against the conical surface.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS.

FIG. 3 is an enlarged fragmentary view taken on the line 3—3 of FIG. 2;

FIG. 5 is a fragmentary top plan view on a reduced scale showing a portion of the blanket.

Similar reference characters refer to similar parts throughout the various views of the drawings.

DETAILED DESCRIPTION OF THE DRAWINGS

Figure 1:
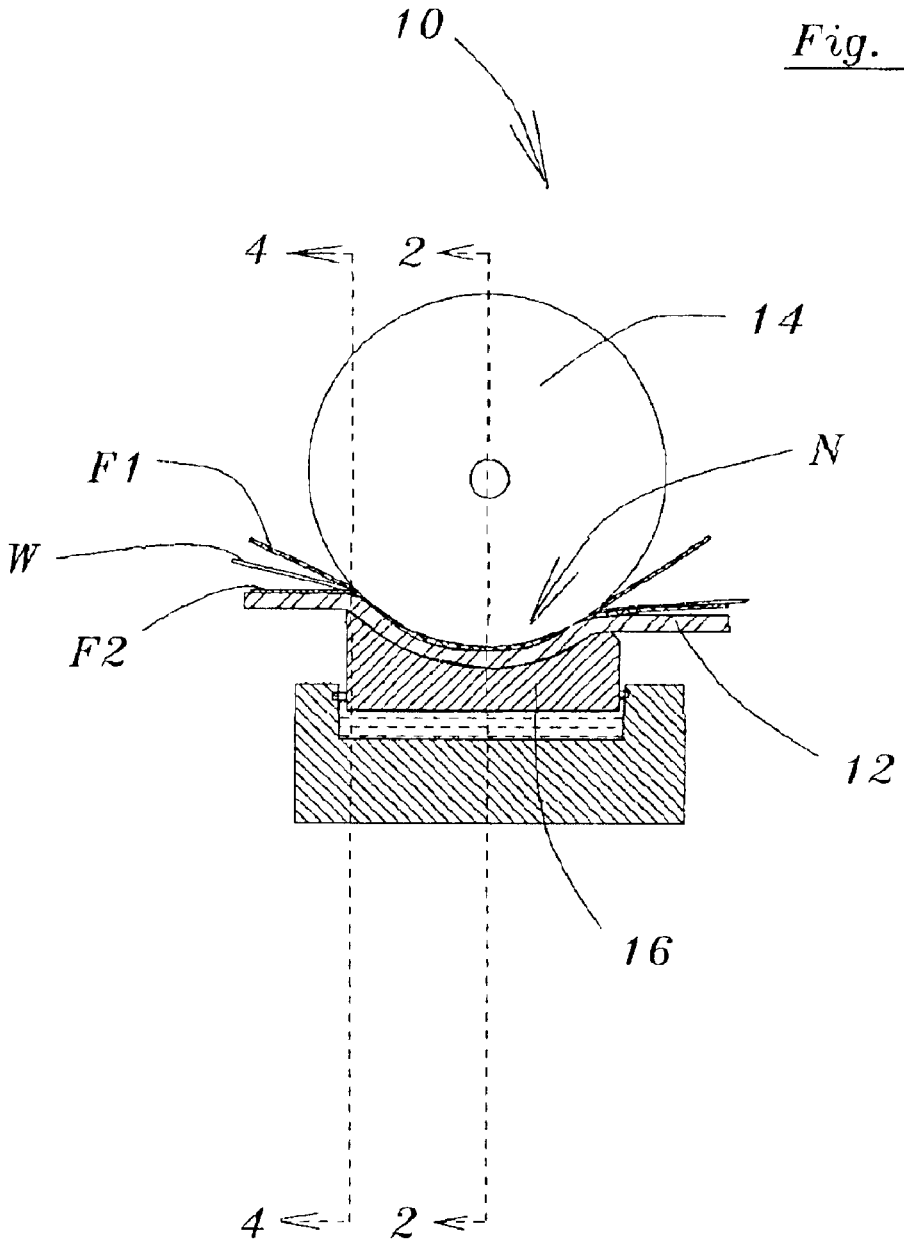
FIG. 1 is a side elevational view of an enclosed shoe press according to the present invention.

FIG. 1 is a side elevational view of an enclosed shoe press generally designated 10 according to the present invention having a press blanket 12 extending through an extended nip N defined between a backing roll 14 and an elongate press shoe 16.

Figure 2:
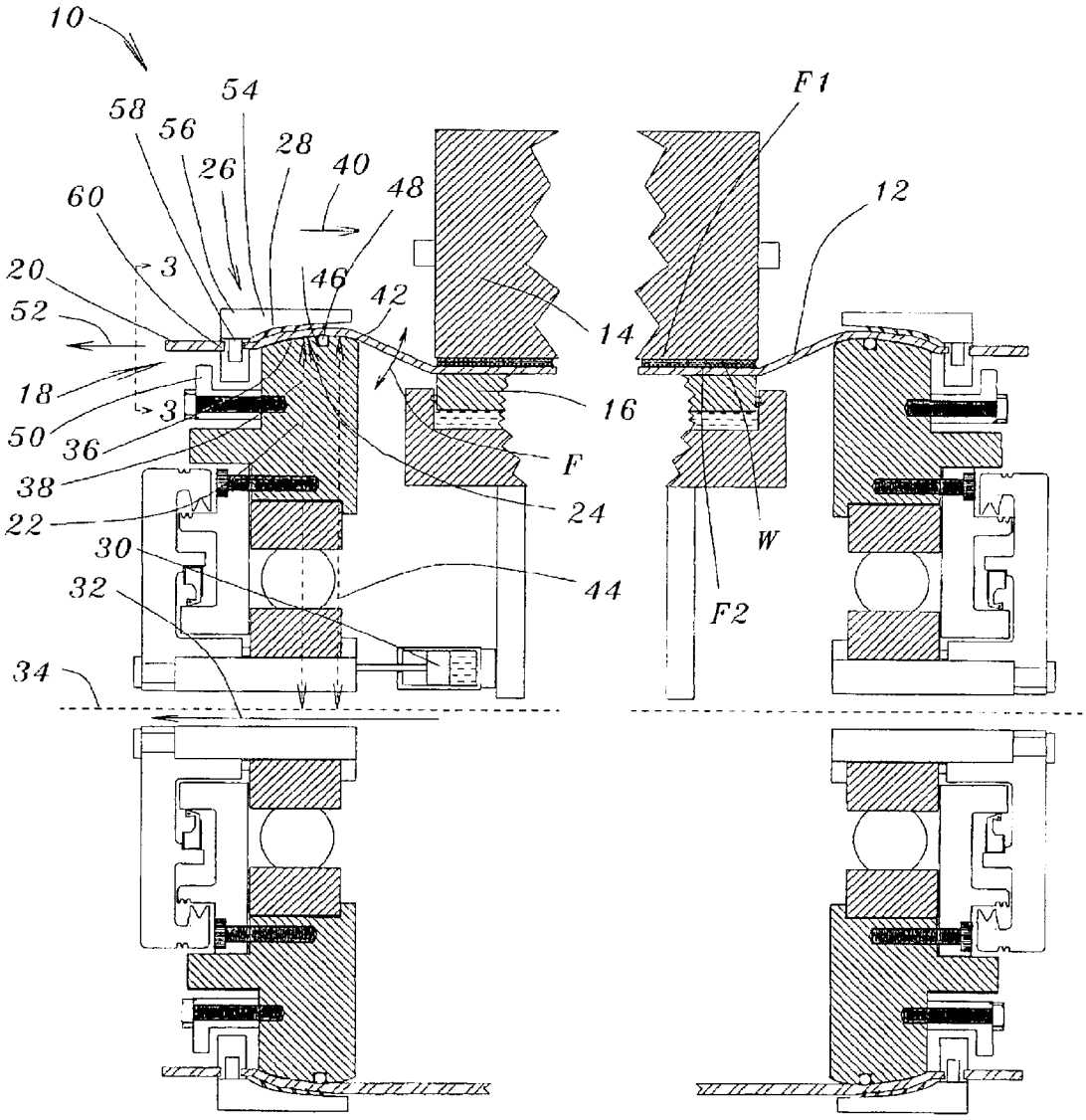
FIG. 2 is a fragmentary view taken on the line 2—2 of FIG. 1.

FIG. 2 is a view taken on the line 2—2 of FIG. 1. As shown in FIG. 2 an anchor device generally designated 18, according to the present invention, is provided for anchoring a peripheral edge 20 of the press blanket 12. The anchor device 18 includes a rotatable head 22 which defines a conical peripheral surface generally designated 24 for supporting the blanket 12. A ring generally designated 26 defines a concave surface 28 which cooperates with the conical surface 24 of the rotatable head 22 such that the peripheral edge 20 of the blanket 12 is anchored between the conical surface 24 of the head 22 and the concave surface 28 of the ring 26. A mechanism 30 such as a hydraulic cylinder is provided for urging the conical surface 24 of the head 22 axially away from the press shoe 16 as indicated by the arrow 32 so that the conical surface 24 moves towards the concave surface 28 of the ring 26 such that the peripheral edge 20 of the blanket 12 is wedged between the conical surface 24 of the head 22 and the concave surface 28 of the ring 26. The arrangement is structured such that when the blanket 12 extends through the extended nip N and during subsequent flexing of the blanket 12, as indicated by the arrow F, the peripheral edge 20 of the blanket 12 is firmly anchored to the conical surface 24 of the rotatable head 22.

In a more specific embodiment of the present invention, the rotatable head 22 is of disc shaped configuration, the head 22 rotating about an axis of rotation 34.

Also, the conical surface 24 includes a first portion 36 having a radius 38 which increases in an axial direction as indicated by the arrow 40 towards the press shoe 16 and a second portion 42 which is disposed between the first portion 36 and the press shoe 16. The second portion 42 of the conical surface 24 has a further radius 44 which decreases in the axial direction 40.

Furthermore, the conical surface 24 defines an annular groove 46 which is disposed between the first and second portions 36 and 42 respectively and the device 18 further includes an annular seal 48 such as an O-ring disposed within the annular groove 46. The annular seal 48 sealingly cooperates with the blanket 12 so that during flexing of the blanket 12 as indicated by the arrow F, the annular seal 48 seals the press shoe 16 within the press blanket 12.

The device 18 according to the present invention further includes a stop 50 which is removably secured to the rotatable head 22 such that the rotatable head 22 is disposed between the stop 50 and the press shoe 16. The stop 50 is provided for limiting movement of the ring 26 axially away from the conical surface 24 in a direction as indicated by arrow 52 in the event of a failure of the press blanket 12.

Moreover, the ring 26 includes a first member 54 which defines the concave surface 28 and a second member 56 which extends from the first member 54, the second member 56 extending axially away from the conical surface 24.

A pin 58 extends radially inwardly from the second member 56, the pin 58 engaging a hole 60 defined by the peripheral edge 20 of the blanket 12.

FIG. 3 is an enlarged view taken on the line 3—3 of FIG. 2 but with the stop 50 removed for clarity. As shown in FIG. 3, the ring 26 includes a plurality of wings 62, 63 and 64 which extend radially inwardly from the second member 56 of the ring 26. Each of the wings 62–64 is spaced circumferentially around the rotatable head 22, the arrangement being such that the pin 58 is disposed between adjacent wings 62 and 63 of the plurality of wings 62–64.

Each wing such as wing 63 of the plurality of wings 62–64 is located within a space 66 defined between adjacent tabs 68 and 70 respectively defined by the peripheral edge 20 of the blanket 12.

Also, the pin 58 disposed between the adjacent wings 62 and 63 extends through the hole 60 which is defined by one of the tabs 68.

More specifically, the pin 58 is located within a grommet 72 extending through the hole 60 defined by the tab 68 of the blanket 12.

Figure 4:
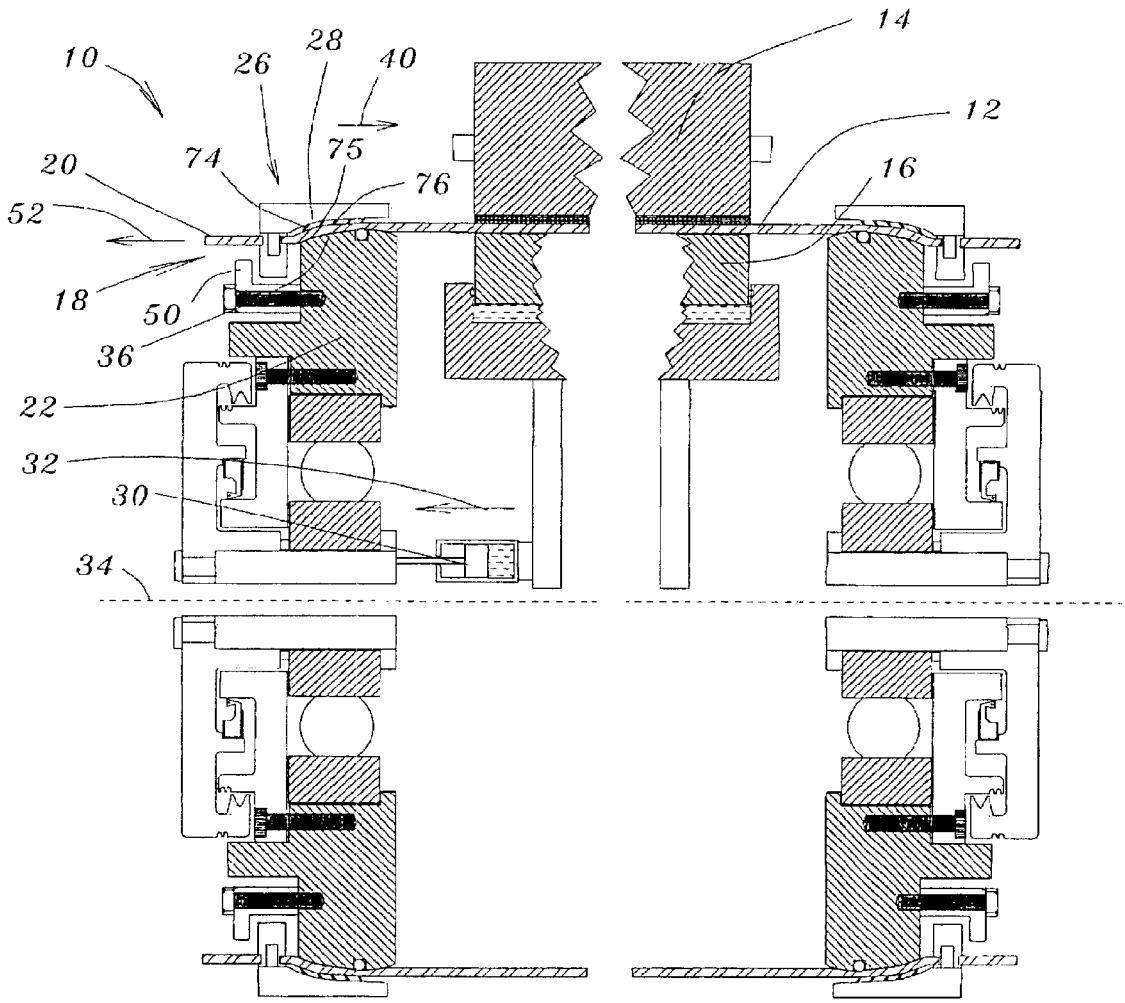
FIG. 4 is a fragmentary view taken on the line 44 of FIG. 1.

FIG. 4 is a view taken on the line 44 of FIG. 1. As shown in FIG. 4, the device 18 further includes a plurality of barbs 74, 75 and 76 which extend away from the concave surface 28 towards the peripheral edge 20 of the blanket 12 for assisting in anchoring the peripheral edge 20 of the blanket 12 against the conical surface 24 of the rotatable head 22.

The barbs 74–76 are inclined in the direction 52 away from the press shoe 16 so that during flexing of the blanket 12 as shown by the arrow F in FIG. 2, the barbs 74–76 increase the anchoring of the peripheral edge 20 of the blanket 12 against the conical surface 24.

FIG. 5 is a fragmentary top plan view on a reduced scale showing a portion of the blanket 12 and the edge 20 thereof. As shown in FIG. 5, the edge 20 of the blanket 12 includes the tabs 68 and 70. Each of the tabs 68 and 70 respectively define a hole 60 for the location therein of a corresponding pin 58 of the ring 26.

In operation of the device according to the present invention, the shoe is unloaded and the stop 50 is removed from both sides of the shoe press. Also the pressure within the mechanism 30 which preferably is a hydraulic cylinder is released. Accordingly, any tension in the blanket 12 is released. Next, the tabs 68 and 70 are pulled away from the second member 56 of the ring 26 so that the pins 58 are released from engagement with the holes 60. The ring 26 is then moved axially in the direction 52 and the barbs 74–76 are able to slide over the outer surface of the edge 20 of the blanket 12. The cylindrical blanket is then removed from the shoe press by moving the blanket 12 axially in the direction 40 as shown in FIG. 2 so that the blanket slides out from the head 22 and from between the backing roll 14 and the press shoe 16.

In order to subsequently fit a new blanket, the new blanket 12 is moved axially in the direction 52 until the edge 20 of the blanket 12 slides over the conical surface 24 of the head 22. The ring 26 is then moved in the direction 40 and each of the tabs 68 and 70 is maneuvered such that each pin 58 engages a corresponding hole 60 in the tabs 68 and 70 and the remaining tabs. When all the pins have been successfully seated within their corresponding holes 60, a ring on the opposite side of the shoe press is similarly fitted so that on both sides of the press, the rings are located with each pin located in a corresponding hole of the edge of the blanket. When the blanket has been correctly aligned hydraulic pressure is applied to the mechanism 30 so that the head 22 is urged outwardly as indicated by arrow 32 so that the barbs 74–76 engage the outer surface of the edge 20 of the blanket 12 for increasing the anchoring of the peripheral edges 20 on both sides of the press. Additionally, as the blanket is tensioned by the mechanism 30, the seal 48 and the inner surface of the blanket come into sealing engagement relative to each other so that any lubricant disposed on the inner surface of the blanket is contained within the confines of the blanket 12 so that marking of the web and contamination of the environment by oil mist is prevented. Finally, the stops 50 on each side of the press are replaced so that in operation of the press, only limited movement of the ring 26 away from the shoe 16 would be possible in the event of the blanket disintegrating.

The basic concept of the present invention includes a "self clamping" principle. The "self clamping" principle means the more you push, the tighter is the clamping. Such clamping is due to the "cone into cone" geometry of the conical and concave surfaces together with the axial-securing systems which include the pins and the barbs. In the system according to the present invention, the piston of the urging mechanism pushes the inner conical surface to force such conical surface of the head into the outer concave surface of the ring. The reaction of the outer concave surface of the ring to the axial force exerted by the inner conical surface of the head is given by the resultant of the blanket tension itself. The blanket is (axially) connected to and secured to the outer ring 26 by two different systems as follows:

1) The pins 58. The pins 58 give first of all the correct alignment of the blanket 12 with the head 22 just after installation. Also, the pins 58 give the first axial connection between the blanket 12 and outer ring 26 when the piston mechanism 30 starts to push and when the blanket 12, due to its own tension begins to pull.
2) The barbs 74–76. Once the conical surface 24 and concave surface 28 get closer and start to squeeze the blanket 12, the barbs 74–76 in the inside of the outer ring concave surface 28 start to enter the blanket surface giving further strength to the connection between outer ring 26 and blanket 12. The engagement of the barbs 74–76 into the blanket material and into the inside textile material of the blanket give the necessary axial resistance to withstand the highest levels of blanket tension. Such axial resistance would not be provided by the pins alone.

In the drawings, it will be appreciated by those skilled in the art that the thickness of the shoe press blanket has been exaggerated in FIG. 1 to emphasize the operation of the press 10. Furthermore, although in FIGS. 1, 2 and 4 the press 10 is shown as including two press felts F1 and F2 respectively for supporting the web W, a single felting arrangement could be used. Also, the blanket 12 could be a vented blanket with a plurality of grooves or blind drilled holes in the upper surface thereof for drainage.

Additionally, although it is preferable that the barbs extend inwardly from the ring 26, the barbs could alternatively extend from the conical surface 24 of the head 22.

The present invention provides a unique arrangement for securely locating and anchoring the edges of a press blanket so that changing of a blanket is greatly simplified.

What is claimed is:

1. In an enclosed shoe press having a press blanket extending through an extended nip defined between a backing roll and a press shoe, an anchor device for anchoring a peripheral edge of the press blanket, said anchor device comprising:

a rotatable head defining a conical peripheral surface for supporting the blanket;

a ring defining a concave surface which cooperates with said conical surface of said rotatable head such that the peripheral edge of the blanket is anchored between said conical surface of said head and said concave surface of said ring;

a pin extending radially inwardly from said ring, said pin engaging a hole defined by the peripheral edge of the blanket;

a plurality of barbs extending away from said concave surface for assisting in anchoring the peripheral edge of the blanket against said conical surface of said rotatable head; and a mechanism for urging said conical surface of said head axially away from the press shoe so that said conical surface moves towards said concave surface of said ring such that the peripheral edge of the blanket is wedged between said conical surface of said head and said concave surface of said ring the arrangement being structured such that when the blanket extends through the extended nip and during subsequent flexing of the blanket, the peripheral edge of the blanket is firmly anchored to said conical surface of said rotatable head.

2. An anchor device as set forth in claim 1 wherein said rotatable head is of disc shaped configuration, said head rotating about an axis of rotation.

3. An anchor device as set forth in claim 2 wherein said conical surface includes:

a first portion having a radius which increases in an axial direction towards the press shoe;

a second portion disposed between said first portion and the press shoe having a further radius which decreases in said axial direction.

4. An anchor device as set forth in claim 3 wherein said conical surface defines an annular groove disposed between said first and second portions;

said device further including:

an annular seal disposed within said annular groove, said annular seal sealingly cooperating with the blanket so that during said flexing of the blanket, said annular seal seals the press shoe within the press blanket.

5. An anchor device as set forth in claim 1 further including:

a stop removably secured to said rotatable head such that said rotatable head is disposed between said stop and the press shoe, said stop limiting movement of said ring axially away from said conical surface in the event of a failure of the press blanket.

6. An anchor device as set forth in claim 1 wherein said ring includes:

a first member which defines said concave surface;

a second member extending from said first member and extending axially away from said conical surface;

said pin extending radially inwardly from said second member.

7. An anchor device as set forth in claim 6 wherein said ring further includes:

a plurality of wings extending radially inwardly from said second member, each of said wings being spaced circumferentially around said rotatable head, the arrangement being such that said pin is disposed between adjacent wings of said plurality of wings.

8. An anchor device as set forth in claim 7 wherein each wing of said plurality of wings is located within a space defined between adjacent tabs defined by the peripheral edge of the blanket.

9. An anchor device as set forth in claim 8 wherein said pin disposed between said adjacent wings extends through the hole defined by one of the tabs.

10. An anchor device as set forth in claim 9 wherein said pin is located within a grommet extending through the hole defined by the tab of the blanket.

11. An anchor device as set forth in claim 1 further including:

said plurality of barbs extend away from said concave surface towards the peripheral edge of the blanket for assisting in anchoring the peripheral edge of the blanket against said conical surface of said rotatable head.

12. An anchor device as set forth in claim 11 wherein said barbs are inclined in a direction away from the press shoe so that during flexing of the blanket, said barbs increase said anchoring of the peripheral edge of the blanket against said conical surface.

13. In an enclosed shoe press having a press blanket extending through an extended nip defined between a backing roll and a press shoe, an anchor device for anchoring a peripheral edge of the press blanket, said anchor device comprising:

a rotatable head defining a conical peripheral surface for supporting the blanket;

a ring defining a concave surface which cooperates with said conical surface of said rotatable head such that the peripheral edge of the blanket is anchored between said conical surface of said head and said concave surface of said ring;

a mechanism for urging said conical surface of said head axially away from the press shoe so that said conical surface moves towards said concave surface of said ring such that the peripheral edge of the blanket is wedged between said conical surface of said head and said concave surface of said ring the arrangement being structured such that when the blanket extends through the extended nip and during subsequent flexing of the blanket, the peripheral edge of the blanket is firmly anchored to said conical surface of said rotatable head;

said ring including:

a first member which defines said concave surface;

a second member extending from said first member and extending axially away from said conical surface; and a pin extending radially inwardly, said pin engaging a hole defined by the peripheral edge of the blanket.

14. In an enclosed shoe press having a press blanket extending through an extended nip defined between a backing roll and a press shoe, an anchor device for anchoring a peripheral edge of the press blanket, said anchor device comprising:

a rotatable head defining a conical peripheral surface for supporting the blanket;

a ring defining a concave surface which cooperates with said conical surface of said rotatable head such that the peripheral edge of the blanket is anchored between said conical surface of said head and said concave surface of said ring;

a piston and cylinder mechanism for urging said conical surface of said head axially away from the press shoe so that said conical surface moves towards said concave surface of said ring such that the peripheral edge of the blanket is wedged between said conical surface of said head and said concave surface of said ring the arrangement being structured such that when the blanket extends through the extended nip and during subsequent flexing of the blanket, the peripheral edge of the blanket is firmly anchored to said conical surface of said rotatable head; and a plurality of barbs extending away from said concave surface of said ring towards the peripheral edge of the blanket for assisting in anchoring the peripheral edge of the blanket against said conical surface of said rotatable head.

* * * * *